US012035831B2

(12) United States Patent
Cassel

(10) Patent No.: US 12,035,831 B2
(45) Date of Patent: Jul. 16, 2024

(54) BEDDING COVER AND INSERT

(71) Applicant: Daisy Cutter, LLC, Coppell, TX (US)

(72) Inventor: Brett Cassel, Coppell, TX (US)

(73) Assignee: Daisy Cutter, LLC, Coppell, TX (US)

( * ) Notice: Subject to any disclaimer, the term of this patent is extended or adjusted under 35 U.S.C. 154(b) by 332 days.

(21) Appl. No.: 17/475,668

(22) Filed: Sep. 15, 2021

(65) Prior Publication Data

US 2022/0079359 A1 Mar. 17, 2022

Related U.S. Application Data

(60) Provisional application No. 63/078,702, filed on Sep. 15, 2020.

(51) Int. Cl.
*A47G 9/02* (2006.01)

(52) U.S. Cl.
CPC ..... *A47G 9/0261* (2013.01)

(58) Field of Classification Search
CPC ..... A47G 9/0261
See application file for complete search history.

(56) References Cited

U.S. PATENT DOCUMENTS 6,032,308 A 3/2000 Chuang
9,867,485 B2 1/2018 Cavosle
2012/0311785 A1* 12/2012 Goldberg ..... A47C 31/105 24/389
2018/0092473 A1* 4/2018 Stewart ..... A47G 9/0207
2022/0175160 A1* 6/2022 Guy ..... A47G 9/0261

FOREIGN PATENT DOCUMENTS

FR 2887415 A1 * 12/2006 ..... A47G 9/0261
GB 2578718 A * 5/2020 ..... A47G 9/0261
WO WO-2010075094 A1 * 7/2010 ..... A47G 9/0207

OTHER PUBLICATIONS

"DuZipp," retrieved from https://www.facebook.com/DuZipp/, Dec. 6, 2016, pp. 1-6.

* cited by examiner

*Primary Examiner* — Adam C Ortiz
(74) *Attorney, Agent, or Firm* — Loyal IP Law, PLLC; Travis Banta

(57) ABSTRACT

A bedding system comprising a bedding insert and a bedding cover is discussed herein. The bedding insert includes a first portion of a zipper that corresponds to a second portion of a zipper found in the bedding cover. The second zipper portion is disposed on an inside portion of the bedding cover near an edge of the bedding cover. The bedding cover further includes a front panel that is connected to a back panel. Also discussed herein, is bedding cover comprising one or more zipper portions disposed on an inside portion near one or more edges of the bedding cover. The bedding cover also includes a front panel and a back panel that is connected to the front panel.

20 Claims, 4 Drawing Sheets

BEDDING COVER AND INSERT

TECHNICAL FIELD

The disclosure relates generally to a system and device that facilitates the incorporation and attachment of a bedding insert into a bedding cover. The bedding insert is inserted into the bedding cover and connected together in a simple efficient manner that securely attaches the bedding insert to the bedding cover.

BACKGROUND

Bedding has been used since antiquity for a variety of purposes. For example, bedding has been used to soften a sleeping surface, to keep the user clean from the sleeping surface, to keep the sleeping surface clean from the user, and to keep the user warm during cold nights. The early Egyptians were known to use cotton bedding that was placed on raised beds. Later, in the $14^{th}$ century, blankets, used for warmth, were woven out of wool. Subsequently, Vikings in the $16^{th}$ century were known to use bedding stuffed with down, wool, or silk. This bedding is still used today and may also be known as a duvet. Duvet comes from the French word meaning down and in the United States is often referred to as a comforter.

Different materials have been used throughout the years to create bedding (i.e., wool, cotton, silk, and more modernly, flannel, lyocell, polyester, microfiber, bamboo) because clean bedding promotes a healthy lifestyle. Historically many pathogens have been found to accumulate in unwashed bedding. Given that, on average, people spend a third of their lives in bed it is important that bedding remains clean to facilitate general health. However, cleaning bedding can be complicated because each different material, used to create bedding, requires a different method of cleaning.

To ease the arduous cleaning process a bedding shell was invented to encapsulate a duvet. This bedding shell protected the duvet from being soiled and could be removed to be washed keeping the duvet clean. This also allowed the user to change styles or designs of the bedding shell without having to replace the duvet itself. However, the bedding shell did have some limitations. For example, once the duvet was placed within the bedding shell the duvet would slide around inside the bedding shell and would end up lumping at one end or another, causing discomfort to many sleepers. To try and provide a solution, fabric ties were placed at every corner of the bedding cover and loops or ties were placed on the duvet to facilitate the attachment of the duvet to the bedding shell. Unfortunately, this solution was inadequate because large portions of the duvet are not attached to the bedding shell and as a result the portion of the duvet not attached to bedding shell still may bunch up or cause a lump within the bedding shell.

Another difficulty that comes from using bedding shells is the process of inserting, or in many cases wrestling, the duvet into the bedding shell. Generally, bedding shells are open at one end and since duvets are typically soft and supple they are hard to control. As a result, stuffing a duvet into a bedding shell is difficult. Frequently, the process is done on top of the bed to allow the user to stand while inserting the duvet. In this circumstance, the bedding shell is placed on the bed and the duvet is either on the ground or on the bed next to the bedding shell. Since the bedding shell only opens up on one end the user has to hold open the shell with one hand and then insert the duvet into the opening with the other hand. During this process, one incorrect movement with the user's hand or arm may cause the duvet to fall to the floor. In other words, if the majority of the weight of the duvet is outside the cover, the user must rely on a single arm or hand to insert the duvet into the bedding shell. If the majority of the weight is on the inside of the bedding shell, the duvet tends to fall down into the bedding shell, causing bunching and lumps. In another potentially simpler method, users turn the bedding shell inside out allowing the user to attach the duvet to the corners of the bedding shell on the inside of the bedding shell. As the user tries to maneuver the bedding shell under and over the duvet to encapsulate the duvet this process still requires one hand to hold open the bedding shell and the other to attempt to stuff in the duvet. In this manner, the user must stuff the duvet into the shell and pull on the shell preferably simultaneously to aid in the insertion of the duvet into the bedding shell. However, in any case, inserting a duvet into a bedding shell is a difficult process which may be physically taxing for many people to the point where those people are not comfortable removing the bedding shell or cleaning the bedding shell, which can in turn lead to a decrease in health as the bedding shell is less and less clean.

SUMMARY

Disclosed herein is a bedding system comprising a bedding insert and a bedding cover. The bedding insert includes a first portion of a zipper that corresponds to a second portion of a zipper found in the bedding cover. The second zipper portion is disposed on an inside portion of the bedding cover near an edge of the bedding cover. The bedding cover further includes a front panel that is connected to a back panel Further disclosed herein is a bedding cover comprising one or more zipper portions disposed on an inside portion near one or more edges of the bedding cover. The bedding cover also includes a front panel and a back panel that is connected to the front panel.

BRIEF DESCRIPTION OF THE DRAWINGS

Non-limiting and non-exhaustive implementations of the present disclosure are described with reference to the following figures, wherein like reference numerals refer to like parts throughout the various views unless otherwise specified. Advantages of the present disclosure will become better understood with regard to the following description and accompanying drawings.

DETAILED DESCRIPTION

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 2:
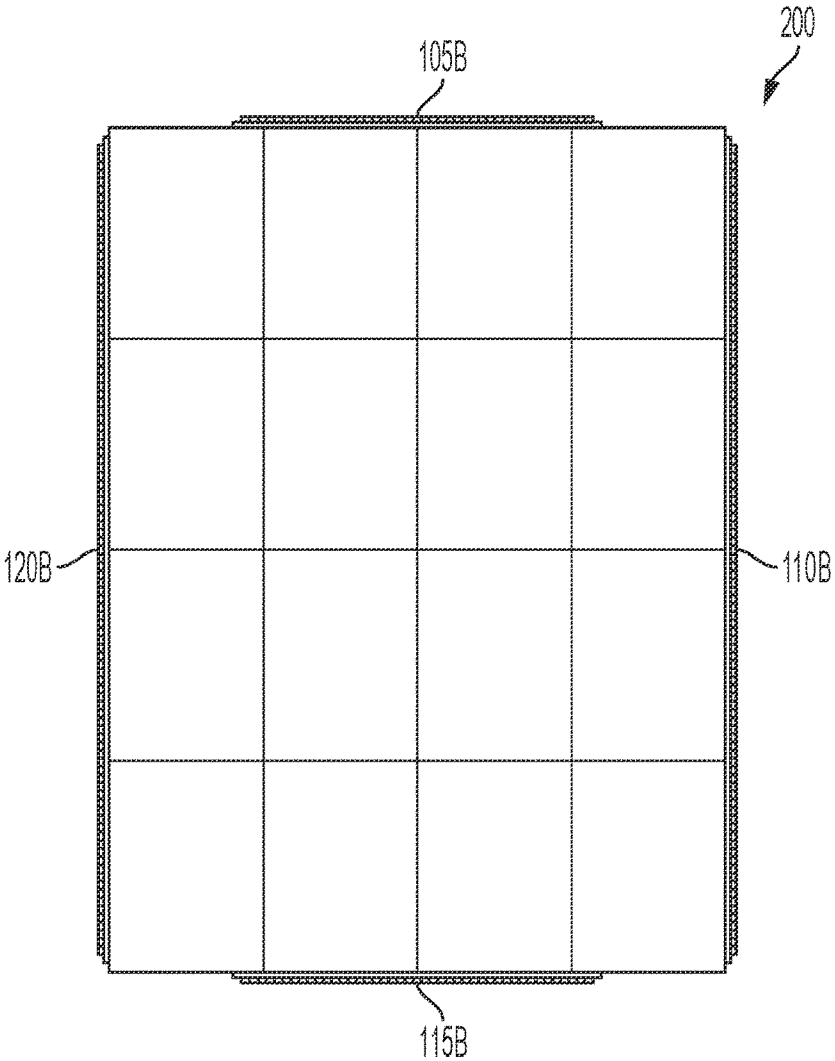
FIG. 2 illustrates a front view of a bedding insert attachable to a bedding cover.
Figure 1:
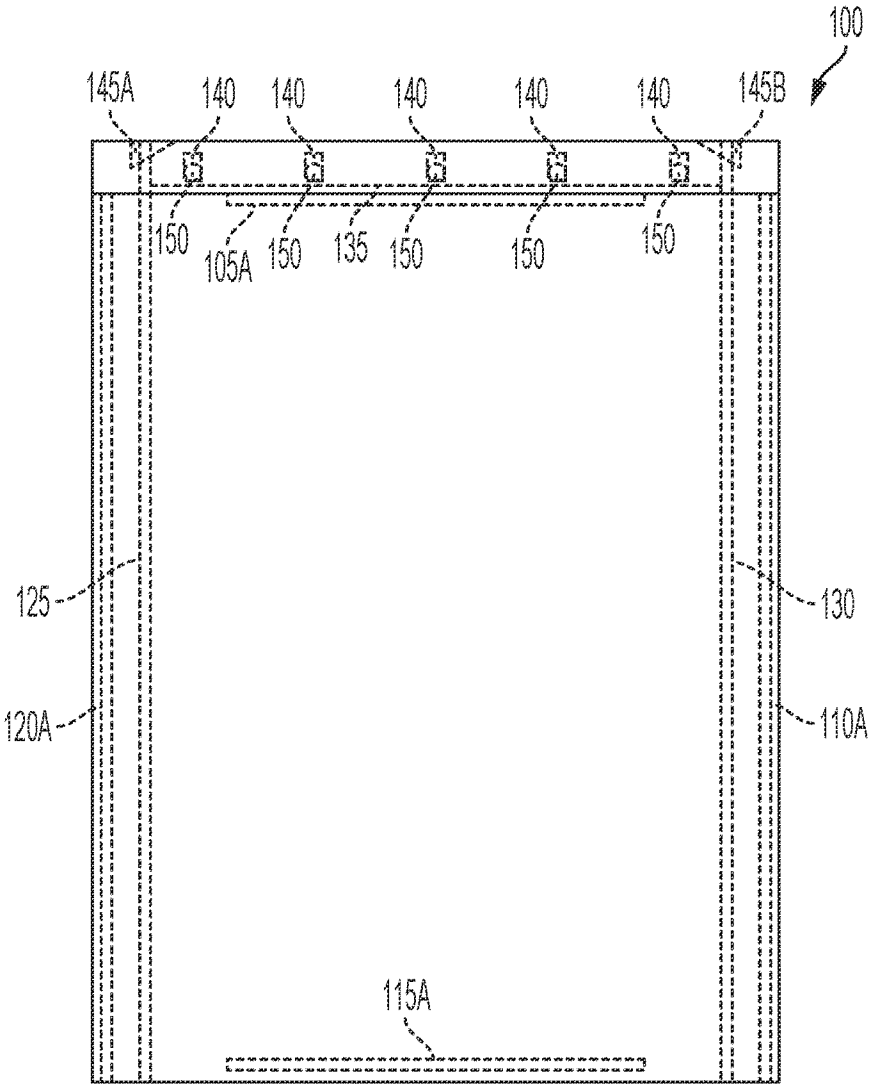
FIG. 1 illustrates a front view of a bedding cover attachable to a bedding insert.

FIG. 1 illustrates a front view of bedding cover 100 that is attachable to a bedding insert shown in FIG. 2. Generally, zippers contain two sides or portions, a first portion and a second portion, each portion having a set of teeth, a top stop, and a bottom stop. The first portion may include a slider and a box as a bottom stop. The second portion may include a pin as a bottom stop that is insertable into the box. A "zipper portion" described herein, may indicate either a first portion attachable to a second portion, or alternatively, a second portion attachable to a first portion. To that end, bedding cover 100 may include top insert zipper portion 105A, right zipper portion 110A, bottom zipper portion 115A, and left zipper portion 120A that zips together with corresponding zipper portions found on an insert (an exemplary insert is depicted in FIG. 2 and described below). Zipper portions 105A, 110A, 115A, and 120A may be concealed between the front panel and the back panel of bedding cover 100.

Furthermore, zipper portions 110A, 115A, and 120A may be disposed on the inside portion of the bedding cover 100, adjacent to and/or near the right, bottom, and left edges of bedding cover 100 correspondingly. Zipper portion 105A may be near the top edge of bedding cover 100 but is inserted beneath the buttonholes 140. Alternatively, zipper portions 105A, 110A, 115A, and 120A may all be disposed at equal distances from their corresponding edges on the inside portion of bedding cover 100.

Furthermore, zipper portions 105A, 110A, 115A, and 120A may all uniformly include the same zipper portion either the first zipper portion (including a slider and a box as a bottom stop) or the second zipper portion (including a pin as a bottom stop). Having bedding cover 100 that includes uniform zipper portions allows a user to attach a bedding insert more easily without having to flip around the insert to try and match it with the corresponding zipper. In a distinct embodiment, bedding cover 100 may include at least a first zipper portion and a second zipper portion.

Bedding cover 100 also may include right back panel zipper 125 and left back panel zipper 130 that allows the back panel to be opened up to attach an insert to bedding cover 100. When the back panel is zipped up, the zipper slider, used to zip together zipper 125, can be placed in zipper pocket 145A. Likewise, the zipper slider used to zip together 130, can be placed in zipper pockets 145. Moreover, additional zipper pockets may be used to conceal additional zipper sliders. For example, zipper portions 105A, 110A, 115A, and 120A may include a zipper pocket for their corresponding zipper slider. Furthermore, the remaining portion of the zippers 125 and 130 may be covered and hidden from view by a portion of material from the back side of bedding cover 100.

The front and back panel of bedding cover 100 may be comprised of one large section of material that is folded back on itself. Alternatively, the front panel and the back panel at the bottom may be otherwise connected (i.e., sewn, woven, glued, fused, stitched etc.). A large portion of the back panel may be separated/opened-up using right back panel zipper 125 and left back panel zipper 130. This exposes the inside portion of the front panel allowing access to zipper portions 105A, 110A, 115A, and 120A. This facilitates the attachment of bedding insert 200 (shown in FIG. 2). Both zippers 125 and 130, that open up a portion of the back panel, may have a layer of material that covers zippers 125 and 130 in a way that hides zippers 125 and 130 from view. Alternatively, many different types and combinations of detachable connectors may be used in place of one or more zippers and/or zipper portions 105A, 110A, 115A, 120A, 125, and 130 (i.e., buttons, snaps, clips, clasps, ties, eyelets and a cord, buckle, hook and loop).

At the top of bedding cover 100, the back panel may attach to the front panel using buttons 150 that attach to buttonholes 140. The buttonholes 140 may be located on a separate panel 135 that is then attached to bedding cover 100. Separate panel 135 may be attached to the inside portion of the front panel between the inside portion of the front panel and the back panel. Alternatively, separate panel 135 may be attached to the inside portion of the back panel between the inside portion of the front panel and the inside portion of the back panel. The separate panel 135 is used to prevent the buttons 150 from being seen on the outside after being inserted into buttonholes 140. Even though bedding cover 100 depicts five buttonhole 140 and five buttons 150 any number of buttons 150 can be used with corresponding buttonholes 140. Alternatively, many different types of detachable connectors may be implemented in place of buttons 150 and buttonholes 140 (i.e., zipper, snaps, clips, clasps, ties, eyelets and a cord, buckle, hook and loop). The different attachments may include additional panels to hide them from view.

FIG. 2 illustrates a front view of a bedding insert 200 attachable to bedding cover 100. Generally, zippers contain two sides or portions, a first portion and a second portion, each portion having a set of teeth, a top stop, and a bottom stop. The first portion may include a slider and a box as a bottom stop. The second portion may include a pin as a bottom stop that is insertable into the box. A "zipper portion" described herein, may indicate either a first portion attachable to a second portion, or alternatively, a second portion attachable to a first portion. Bedding insert 200 may include zipper portions 105B, 110B, 115B and 120B. Zipper portion 105B zips together with zipper portion 105A as does zipper portion 110B with zipper portion 110A, zipper portion 115B with zipper portion 115A, and zipper portion 120B with zipper portion 120A. This secures bedding insert 200 to the inside portion of bedding cover 100. Zipper portions 105B, 110B, 115B and 120B are found along the outer edges of bedding insert 200. Accordingly, zipper portions 105B, 110B, 115B and 120B respectively correspond to zipper portions 105A, 110A, 115A, and 120A and are located at or near the edge on the inside portion of bedding cover 100. The only exception may be zipper portion 105A that is positioned further down from the edges as compared to zipper portions, 110A, 115A, and 120A which allows buttons 150 to be placed in buttonholes 140. Both buttons 150 and buttonholes 140 are above zipper portion 105A. Furthermore, bedding insert zipper portions 105B, 110B, 115B and 120B may be covered by a flap of material hiding them from view but allowing the flap to move to expose the zippers for attachment to bedding cover 100. This flap of material also may hide the zippers from touch if bedding insert 200 is used without being inserted into bedding cover 100 such that the user will not feel the zippers and/or zipper portions.

Figure 3:
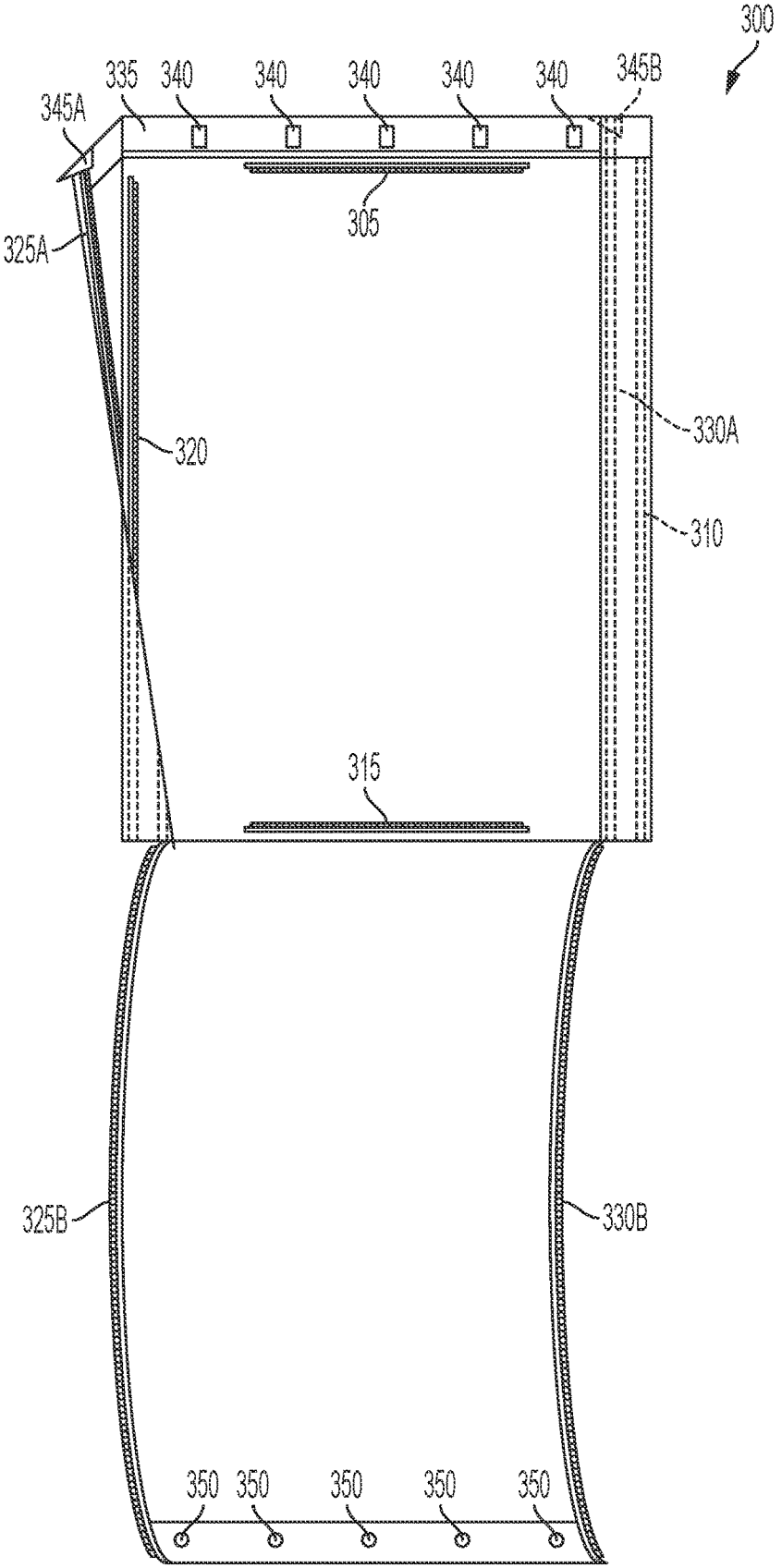
FIG. 3 illustrates a back view of an open bedding cover that is attachable to a bedding insert.

FIG. 3 illustrates a back view of an open bedding cover that is attachable to a bedding insert. Generally, zippers contain two sides or portions, a first portion and a second portion, each portion having a set of teeth, a top stop, and a bottom stop. The first portion may include a slider and a box as a bottom stop. The second portion may include a pin as a bottom stop that is insertable into the box. A "zipper portion" described herein, may indicate either a first portion attachable to a second portion, or alternatively, a second portion attachable to a first portion. Bedding cover 300 may include top insert zipper portion 305, right zipper portion 310, bottom zipper portion 315, and left zipper portion 320 that zips together with corresponding zippers found on an insert as depicted in FIG. 2. Zipper portions 305, 310, 315, and 320 may be concealed between the front panel and the back panel of bedding cover 300. Zipper portions 310, 315, and 320 may be disposed on the inside portion of the bedding cover 300, adjacent to and/or near the right, bottom and left edges of bedding cover 300 correspondingly. Zipper portion 305 may be near the top edge of bedding cover 300 but is inserted beneath the buttonholes 340. Alternatively, zipper portions 305, 310, 315, and 320 may all be disposed at equal distances from their corresponding edges on the inside portion of bedding cover 300.

Bedding cover 300 also may include right back panel zipper 325 and left back panel zipper 330 that allows the back panel to be opened up, in essentially a clam shell fashion, to attach an insert. When the back panel is zipped up, a zipper slider used to zip together 325A to 325B can be placed in zipper pocket 345A. Likewise, a zipper slider used to zip together 330A to 330B, can be placed in zipper pocket 345B. Moreover, additional zipper pockets may be used to conceal additional zipper sliders. For example, zipper portions 305, 310, 315, and 320 may include a zipper pocket for their corresponding zipper slider or zipper portions 305, 310, 315 and 320 may include dual zipper pulls which may slide in the same or opposite directions. Furthermore, the remaining portion of the zippers 325 and 330 may be covered and hidden from view by a portion of material from the back side of bedding cover 300.

The front and back panel of bedding cover 300 may be comprised of one large section of material that is folded back on itself. Alternatively, the front panel and the back panel at the bottom may be otherwise connected (i.e., sewn, woven, glued, fused, stitched etc.). A large portion of the back panel may be separated/opened using right back panel zipper 325A-B and left back panel zipper 430A-B. This exposes the inside portion of the front panel allowing access to zipper portions 305, 310, 315, and 320. This facilitates the attachment of bedding insert 360. Both zippers 325 and 330, that open up a portion of the back panel, may have a layer of material that covers zippers 325A and 330A in a way that hides zippers 335A and 330A from view. Alternatively, many different types of detachable connectors may be used in place of one or more zippers and/or zipper portions 305, 310, 315, 320, 325, and 330 (i.e., buttons, snaps, clips, clasps, ties, eyelets and a cord, buckle, hook and loop).

At a top of bedding cover 300, a back panel may attach to a front panel using buttons 350 that attach to buttonholes 340. The buttonholes 340 are located on a separate panel 335 that is then attached to bedding cover 300. Separate panel 335 may be attached to the inside portion of the front panel between the inside portion of the front panel and the back panel. Alternatively, separate panel 335 may be attached to the inside portion of the back panel between the inside portion of the front panel and the inside portion of the back panel. Separate panel 335 is used to prevent the buttons 350 from being seen on the outside after being inserted into buttonholes 340. Even though bedding cover 300 depicts five buttonholes 340 and five buttons 350 any number of buttons 350 can be used with corresponding buttonholes 340. Alternatively, many different types of detachable connectors may be implemented in place of buttons 350 and buttonholes 340 (i.e., zipper, snaps, clips, clasps, ties, eyelets and a cord, buckle, hook and loop). The different attachments may include additional panels to hide them from view.

Figure 4B:
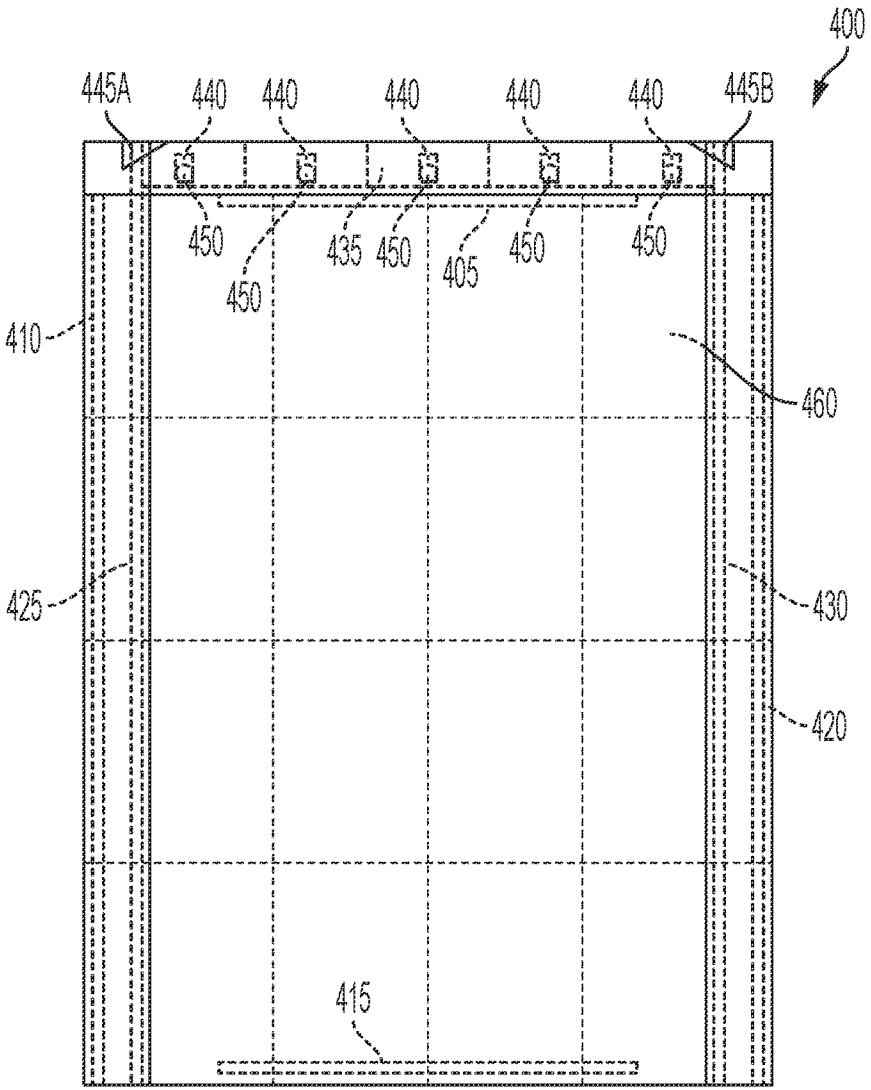
FIG. 4B illustrates a back view of a bedding cover attached to a bedding insert.
Figure 4A:
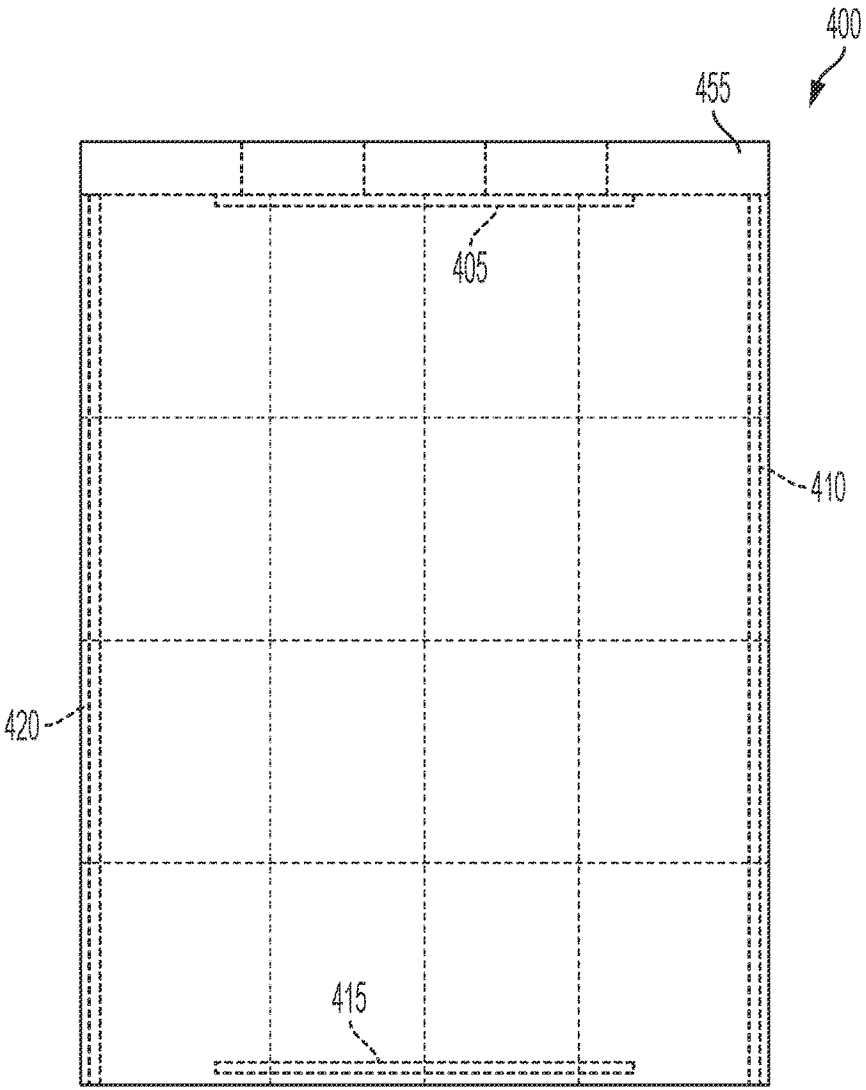
FIG. 4A illustrates a front view of a bedding cover attached to a bedding insert.

FIGS. 4A and 4B depict the front and back side combined bedding cover and insert 400. Bedding cover and insert 400 includes bedding cover 455 and insert 460. Generally, zippers contain two sides or portions, a first portion and a second portion, each portion having a set of teeth, a top stop, and a bottom stop. The first portion may include a slider and a box as a bottom stop. The second portion may include a pin as a bottom stop that is insertable into the box. A "zipper portion" described herein, may indicate either a first portion attachable to a second portion, or alternatively, a second portion attachable to a first portion. Bedding cover 455 may be attached to insert 460 by top zipper portion 405, right zipper portion 410, bottom zipper portion 415, and left zipper portion 420 that are zipped together with corresponding zippers found on insert 460. Zipper portions 405, 410, 415, and 420 are concealed between the front panel and the back panel of bedding cover 455. Zipper portions 410, 415, and 420 may be disposed on the inside portion of the bedding cover 400, adjacent to and/or near the right, bottom and left edges of bedding cover 400 correspondingly. Zipper portion 405 may be near the top edge of bedding cover 400 but is inserted beneath the buttonholes 440. Alternatively, zipper portions 405, 410, 415, and 420 may all be disposed at equal distances from their corresponding edges on the inside portion of bedding cover 400.

Bedding cover 455 also may include right back panel zipper 425 and left back panel zipper 430 that allows the back panel to be opened up to attach insert 460. When the back panel is zipped up, the zipper slider, used to zip together zipper 425, can be placed in zipper pocket 445A. Likewise, the zipper slider used to zip together 430, can be placed in zipper pockets 445. Moreover, additional zipper pockets may be used to conceal additional zipper sliders. For example, zipper portions 405, 410, 415, and 420 may include a zipper pocket for their corresponding zipper slider. Furthermore, the remaining portion of the zippers 425 and 430 may be covered and hidden from view by a portion of material from the back side of bedding cover 400.

A front and back panel of bedding cover 455 may be comprised of one large section of material being folded back on itself. Alternatively, the front panel and the back panel at the bottom may be otherwise connected (i.e., sewn, woven, glued, fused, stitched etc.). A large portion of the back panel may be separated/opened-up using right back panel zipper 425 and left back panel zipper 430. This exposes the inside portion of the front panel allowing access to zipper portions 405, 410, 415, and 420. This facilitates the attachment of bedding insert 460. Both zippers 425 and 430, that open up a portion of the back panel, may have a layer of material that covers zippers 425 and 430 in a way that hides zippers 435 and 430 from view. Alternatively, many different types of detachable connectors may be used in place of one or more zippers and/or zipper portions 405, 410, 415, 420, 425, and 430 (i.e., buttons, snaps, clips, clasps, ties, eyelets and a cord, buckle, hook and loop).

At the top of bedding cover 455, the back panel may attach to the front panel using buttons 450 that attach to buttonholes 440. The buttonholes 440 are located on a separate panel 435 that is then attached to bedding cover 400. Separate panel 435 may be attached to the inside portion of the front panel between the inside portion of the front panel and the back panel. Alternatively, separate panel 435 may be attached to the inside portion of the back panel between the inside portion of the front panel and the inside portion of the back panel. The separate panel 435 is used to prevent the buttons 450 from being seen on the outside after being inserted into buttonholes 440. Even though bedding cover 400 depicts five buttonhole 440 and five buttons 450 any number of buttons 450 can be used with corresponding buttonholes 440. Alternatively, many different types of detachable connectors may be implemented in place of buttons 450 and buttonholes 440 (i.e., zipper, snaps, clips, clasps, ties, eyelets and a cord, buckle, hook and loop). The different attachments may include additional panels to hide them from view.

Figure 5B:
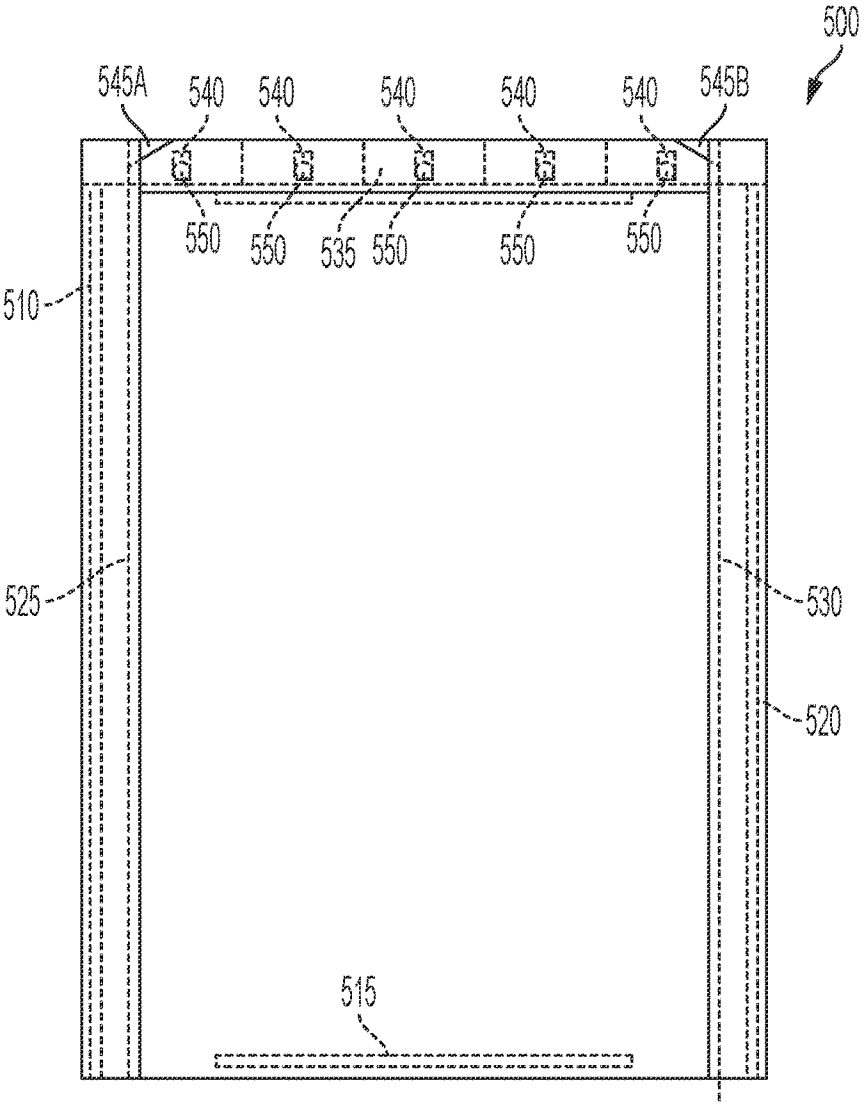
FIG. 5B illustrates a back view of a bedding cover unattached to a bedding insert.
Figure 5A:
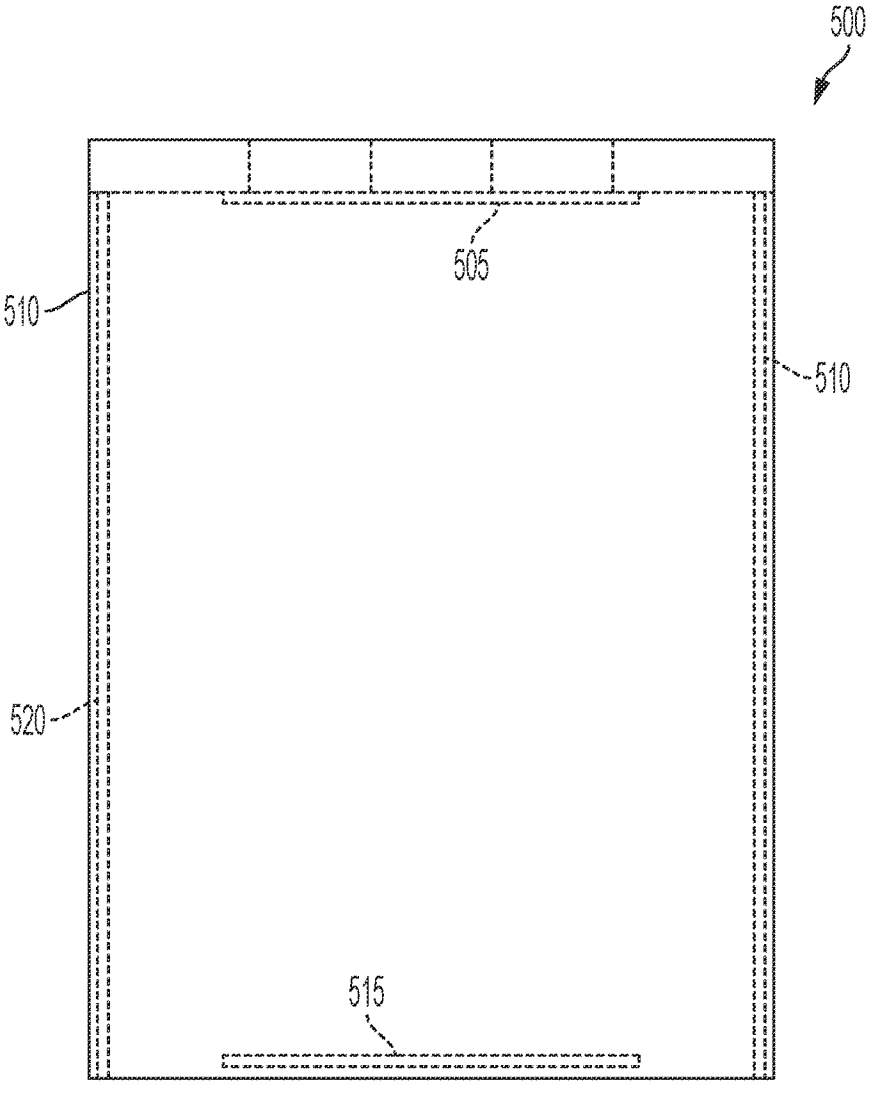
FIG. 5A illustrates a front view of a bedding cover unattached to a bedding insert.

FIGS. 5A and 5B depict a front and a back view of bedding cover 500 unattached to a bedding insert. Generally, zippers contain two sides or portions, a first portion and a second portion, each portion having a set of teeth, a top stop, and a bottom stop. The first portion may include a slider and a box as a bottom stop. The second portion may include a pin as a bottom stop that is insertable into the box. A "zipper portion" described herein, may indicate either a first portion attachable to a second portion, or alternatively, a second portion attachable to a first portion. Bedding cover 500 may include top insert zipper portions 505, right zipper portion 510, bottom zipper portion 515, and left zipper portion 520 that zips together with corresponding zippers found on an insert as depicted in FIG. 2. Zipper portions 505, 510, 515, and 520 are concealed between the front panel and the back panel of bedding cover 500. Zippers portions 510, 515, and 520 may be disposed on the inside portion of the bedding cover 500, adjacent to and/or near the right, bottom and left edges of bedding cover 500 correspondingly. Zipper portion 505 may be near the top edge of bedding cover 500 but is inserted beneath the buttonholes 540. Alternatively, zipper portions 505, 510, 515, and 520 may all be disposed at equal distances from their corresponding edges on the inside portion of bedding cover 500.

Bedding cover 500 also may include right back panel zipper 525 and left back panel zipper 530 that allows the back panel to be opened up to attach an insert. When the back panel is zipped up, the zipper slider, used to zip together zipper 525, can be placed in zipper pocket 545A. Likewise, the zipper slider used to zip together 530, can be place in zipper pockets 545. Moreover, additional zipper pockets may be used to conceal additional zipper sliders. For example, zipper portions 505, 510, 515, and 520 may include a zipper pocket for their corresponding zipper slider. Furthermore, zippers 525 and 530 may be covered and hidden from view by a portion of material from the back side of bedding cover 500 that movably lays over zippers 525 and 530.

The front and back panel of bedding cover 500 may be comprised of one large section of material being folded back on itself. Alternatively, the front panel and the back panel at the bottom may be otherwise connected (i.e., sown, weaved, glued, fused, stitched etc.). A large portion of the back panel may be separated/opened-up using right back panel zipper 525 and left back panel zipper 530. This exposes the inside portion of the front panel allowing access to zipper portions 505, 510, 515, and 520. This facilitates the attachment of bedding insert 560. Both zippers 525 and 530, that open up a portion of the back panel, may have a layer of material that covers zippers 525 and 530 in a way that hides zippers 535 and 530 from view. Alternatively, many different types of detachable connectors may be used in place of one or more zippers and/or zipper portions 505, 510, 515, 520, 525, and 530 (i.e., buttons, snaps, clips, clasps, ties, eyelets and a cord, buckle, hook and loop).

At the top of bedding cover 500, a back panel may attach to a front panel using buttons 550 that attach to buttonholes 540. The buttonholes 540 are located on a separate panel 535 that is then attached to bedding cover 500. Separate panel 535 may be attached to the inside portion of the front panel between the inside portion of the front panel and the back panel. Alternatively, separate panel 535 may be attached to the inside portion of the back panel between the inside portion of the front panel and the inside portion of the back panel. Separate panel 535 is used to prevent the buttons 550 from being seen on the outside after being inserted into buttonholes 540. Even though bedding cover 500 depicts five buttonholes 540 and five buttons 550 any number of buttons 550 can be used with corresponding buttonholes 540. Alternatively, many different types of detachable connectors may be implemented in place of buttons 550 and buttonholes 540 (i.e., zipper, snaps, clips, clasps, ties, eyelets and a cord, buckle, hook and loop). The different attachments may include additional panels to hide them from view.

In practice, bedding cover 500 that is unattached to bedding insert 200 is laid face down on a bed or the floor zippers 525 and 530 are unzipped so that the back panel remains attached to the front panel as shown in FIG. 3. Zipper portions 305 and 315, as seen in FIG. 3, are now exposed while zipper portions 310 and 320 may be hidden under a portion of the back panel that contains zippers 325A and 330A. Now bedding insert 200, as shown in FIG. 2, may be placed on top of the open bedding cover 300. Zippers from bedding insert 200 contain a row of zipper teeth that correspond with zipper teeth found on zippers on the inside portion of bedding cover 300. For example, zipper portion 1058, as seen in FIG. 2, contains a row of zipper teeth compatible with a row of zipper teeth found on zipper portion 305 as seen in FIG. 3. Accordingly, zipper portion 1058 may attach to zipper portion 305 and zipper portion 1108 may be attached to zipper portion 310. In the same manner, zipper portion 1158 may be zipped together with zipper portion 315 and zipper portion 1208 may zip together with zipper portion 320. Then bedding insert 200 is zipped together to bedding cover 300 on all four edges bedding cover 300 may be closed. To close bedding cover 300, the open flap on the back of bedding cover 300 may be folded back onto the exposed bedding insert 200. Then zipper teeth from zipper 325B may be zipped together with zipper teeth on zipper 325A. Likewise, zipper teeth from zipper 330B may be zipped together with teeth from zipper 330A. Then, the zipper sliders that connected both zippers 325 and 330 may be placed in zipper pockets 345A and 345B respectively. Now the bedding cover 300 is closed on 3 sides. The top edges of bedding cover 300 may be attached last.

To attach the top edge of bedding cover 300 buttons 350 are located on one of the top edges of bedding cover 300. On the corresponding top edge buttonholes 340, which receive buttons 350 are disposed into panel 335 that is separate from an outside portion of bedding cover 300. Panel 335 allows buttons 350 to be placed in buttonholes 340 in a manner that conceals buttons 350 from the outside of bedding cover 300. Once buttons 350 have been placed in buttonholes 340, cover 300 has been closed on all sides. There are no exposed buttons or zippers because a layer of fabric conceals all zippers and all the buttons. As a result, the combined bedding cover 300 and bedding insert 200 is effectively shown in FIG. 4 as combined bedding cover and insert 400. Bedding cover and insert 400 may include different designs/patterns on the outside of the bedding cover 455 such that either side of the cover may be situated on the bed according to the aesthetic desires of the user.

What is claimed is:

1. A bedding system comprising:
a bedding cover comprising:
a front panel comprising:
a first zipper portion disposed on an inside portion near an edge of the front panel;
wherein a first end of the first zipper portion ends prior to an outside edge of the inside portion of front panel;
wherein a second end of the first zipper portion ends at an opposing outside edge of the inside portion of the front panel;
a second zipper portion positioned towards a middle point of the bedding cover as compared to the first zipper portion;
wherein a first end and a second end of second zipper portion ends at opposing outside edges of the front panel;
a back panel comprising:
a third zipper portion disposed along an outside edge of a separated portion of the back panel connectable to the second zipper portion;
wherein the separated portion of back panel is smaller in size than the front panel and is attached to a bottom end of the front panel;
a bedding insert comprising:
a fourth zipper portion disposed along an outside edge of the bedding insert; and
wherein the first zipper portion of the bedding cover is connectable with the fourth zipper portion of the bedding insert.

2. The bedding system of claim 1, the bedding insert further comprising:
a fifth zipper portion.

3. The bedding system of claim 2, the bedding cover further comprising:
a sixth zipper portion connectable with the fifth zipper portion of the bedding insert.

4. The bedding system of claim 3, the bedding cover further comprising:
a seventh zipper portion attached to the separated portion of the back panel and is connectable to an eighth zipper portion disposed on the back panel.

5. The bedding system of claim 4, wherein the eighth zipper portion on the bedding cover is located further from an edge of the bedding cover than the sixth zipper portion.

6. The bedding system of claim 5, the bedding cover further comprising:
one or more zipper pockets sized to house one or more zipper sliders attached to the one or more zippers.

7. The bedding system of claim 1, the bedding cover further comprising:
one or more buttons.

8. The bedding system of claim 7, the bedding cover further comprising:
one or more buttonholes sized to receive the one or more buttons.

9. The bedding system of claim 8, wherein the buttons are located on the back panel.

10. The bedding system of claim 9, wherein the buttonholes are located on a panel attached to a back side of the front panel.

11. A bedding cover comprising:
a front panel comprising:
a first zipper portion disposed on an inside portion near an edge of the front panel;
wherein a first end of the first zipper portion ends prior to an outside edge of the inside portion of the front panel;
wherein a second end of the first zipper portion ends at an opposing outside edge of the inside portion of the front panel;
a second zipper portion positioned towards a middle point of the bedding cover as compared to the first zipper portion;
wherein a first end and a second end of second zipper portion ends at opposing outside edges of the front panel;
a back panel connected to the front panel comprising:
a third zipper portion disposed along an outside edge of a separated portion of the back panel connectable to the second zipper portion;
wherein the separated portion of the back panel is smaller in size than the front panel and is attached to a bottom end of the front panel.

12. The bedding cover of claim 11, the cover further comprising:
another zipper portion attached to an opposite edge of the separated separating a portion of the back panel from the third zipper portion.

13. The bedding cover of claim 12, wherein the the second zipper portion is located further from an edge of the bedding cover than the first zipper portion.

14. The bedding cover of claim 13, wherein the bedding cover further comprising:
one or more zipper pockets.

15. The bedding cover of claim 14, wherein the zipper pockets are sized to house one or more zipper sliders attached to the one or more zippers.

16. The bedding cover of claim 11, wherein the bedding cover further comprises:
one or more buttons.

17. The bedding cover of claim 16, wherein the bedding cover further comprises:
one or more buttonholes sized to receive the one or more buttons.

18. The bedding cover of claim 17, wherein the buttons are located on a panel attached to a back side of the front panel.

19. The bedding cover of claim 18, wherein first zipper portion is positioned further down from an upper edge of the bedding cover lower than the one or more buttonholes.

20. The bedding cover of claim 11, further comprising:
a bedding insert comprising:
a zipper portion disposed along an outside edge of the bedding insert.

* * * * *